US007681429B1

(12) United States Patent
Huang et al.

(10) Patent No.: US 7,681,429 B1
(45) Date of Patent: Mar. 23, 2010

(54) STRUCTURE OF RIVET FIXING DEVICE

(76) Inventors: Ting-Chun Huang, 6F., No. 10, Alley 1, Lane 77, Nung An Street, Taipei City (TW); Chin-Liang Chen, No. 103, Sec. 4, Chung Chin N. Road, Shihlin District, Taipei City (TW)

( * ) Notice: Subject to any disclaimer, the term of this patent is extended or adjusted under 35 U.S.C. 154(b) by 0 days.

(21) Appl. No.: 12/198,905

(22) Filed: Aug. 27, 2008

(51) Int. Cl.
*B21J 15/34* (2006.01)
*B21J 15/26* (2006.01)

(52) U.S. Cl. ..... 72/391.8; 72/114; 29/243.521; 29/243.526

(58) Field of Classification Search ..... 29/243.521, 29/243.526, 243.53; 72/114, 391.8
See application file for complete search history.

(56) References Cited

U.S. PATENT DOCUMENTS 2,384,037 A * 9/1945 Kugler ..... 29/243.526
3,423,986 A * 1/1969 Young ..... 29/243.526
3,626,745 A * 12/1971 Richardson et al. .... 29/243.526
3,686,915 A * 8/1972 Miller et al. ..... 72/114
3,774,437 A * 11/1973 Young ..... 29/243.526
3,906,775 A * 9/1975 Benimetzki ..... 29/243.526
4,063,443 A * 12/1977 Yarbrough ..... 29/243.526
4,070,889 A * 1/1978 DeCaro ..... 72/114
4,368,631 A * 1/1983 Tanikawa ..... 72/391.8
4,574,612 A * 3/1986 Tanikawa ..... 72/391.8
4,910,992 A * 3/1990 Stenberg et al. ..... 29/243.521
5,219,375 A * 6/1993 Kamata et al. ..... 29/243.526
5,802,691 A * 9/1998 Zoltaszek ..... 29/243.526

* cited by examiner

*Primary Examiner*—David B Jones
(74) *Attorney, Agent, or Firm*—Leong C. Lei

(57) ABSTRACT

A rivet fixing device includes a catch tab retainer tube engageable with a transmission spindle of an electrically-operated, pneumatic or battery-powered electric drill or screwdriver, an inner guide sleeve, a driver, pawls, a rivet breaker, and an outer guide sleeve. By being driven by the transmission structure of the electric screwdriver, a rivet, with a shank section thereof inserted into a front end of the rivet breaker and the rivet being fit through holes defined in steel plates, iron plates, copper plates, or aluminum plates, due to the catch tab retainer tube being depressed inward to engage the transmission spindle, is driven by the rearward movement of the catch tab retainer tube to have a fit end thereof that extends beyond the holes of the plates squeezed and deformed to form an expanded portion, serving as a positioning wall that stretches and secures the rivet between the two metal plates.

2 Claims, 8 Drawing Sheets

STRUCTURE OF RIVET FIXING DEVICE

TECHNICAL FIELD OF THE INVENTION

The present invention generally relates to a structure of a rivet fixing device, and more particularly to a transmission structure that is conveniently operated to efficiently and easily mounting a rivet for securing an object. The rivet fixing device can be rotatably coupled to a regular pneumatic, electrically-operated, or battery-powered electric drill or screwdriver, especially for a chargeable screwdriver, which after being fully charged, can be carried to any working site due to its easy portability and can be set in operation without any power source or air compressor, and thus features easy carrying and practicability, being a widely used device.

DESCRIPTION OF THE PRIOR ART

A conventional riveting tool available in the market, either used indoors or outdoors, requires an air compressor to provide desired power for driving the tool. This is feasible for operation in a factory shop, but is certainly adverse to the current trend when it is moved and operated outside the factory shop, due to being power-consuming, bulky, and troublesome. Further, the noise of the air compressor also raises a problem against the current trend of providing an environment-conservative working environment. Due to such reasons, the present inventor, based on his years' experience in this field, as well as repeated and extensive development and research, creates the present invention, which features advantages of being easy to carry, practicable, and economic.

SUMMARY OF THE INVENTION

An objective of the present invention is to provide a structure of a rivet fixing device, with which the mounting operation of a rivet is made convenient, wherein the rivet, after mounted, is tightly secured to metal plates of any type and size and is not easy to separate therefrom.

The rivet fixing device generally comprises constituent components/parts rotatably connectable with a transmission spindle of an electrically-operated or battery-powered electric drill or power screwdriver and including a catch tab retainer tube engageable with the transmission spindle, an inner guide sleeve, a driver, pawls, a rivet breaker, and an outer guide sleeve. By being driven by the transmission structure of the electric screwdriver, a rivet is driven by the rearward movement of the catch tab retainer tube to have a fit end thereof that extends beyond the holes of the plates squeezed and deformed to form an expanded portion, serving as a positioning wall that stretches and secures the rivet between the two metal plates. With the inward movement, the catch tab retainer tube is moved into a bulging chamber of the inner guide sleeve and the catch tabs are driven by a tapering section of the transmission spindle to bulge outward, making the catch tabs that are located in circular openings of the catch tab retainer tube outward expanding and the catch tab retainer tube is returned and set in the original position. The rivet is broken or cut off by the rivet breaker. As such, a convenient and effective operation of mounting a rivet is realized.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
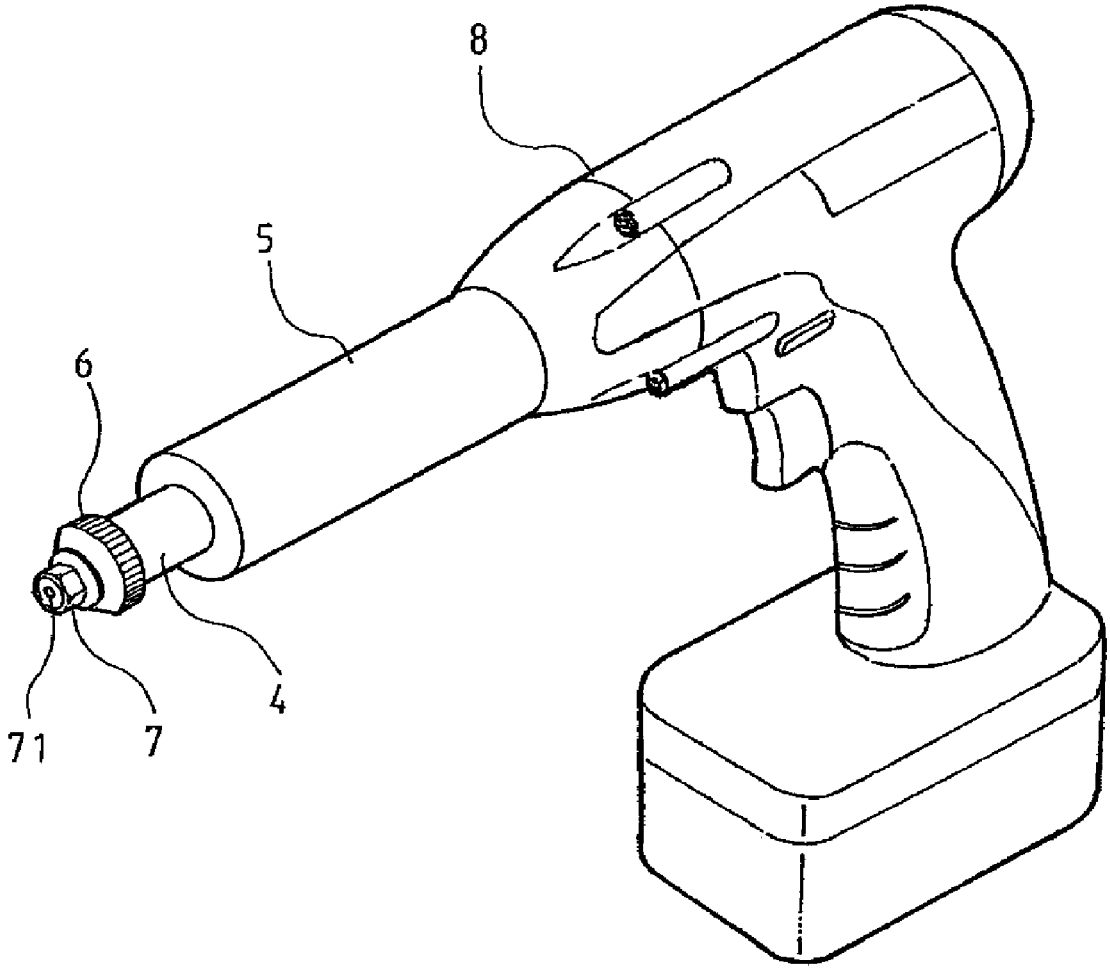
FIG. 1 is a perspective view of a riveting fixing device in accordance with the present invention coupled to a battery-powered electric drill.
Figure 2:
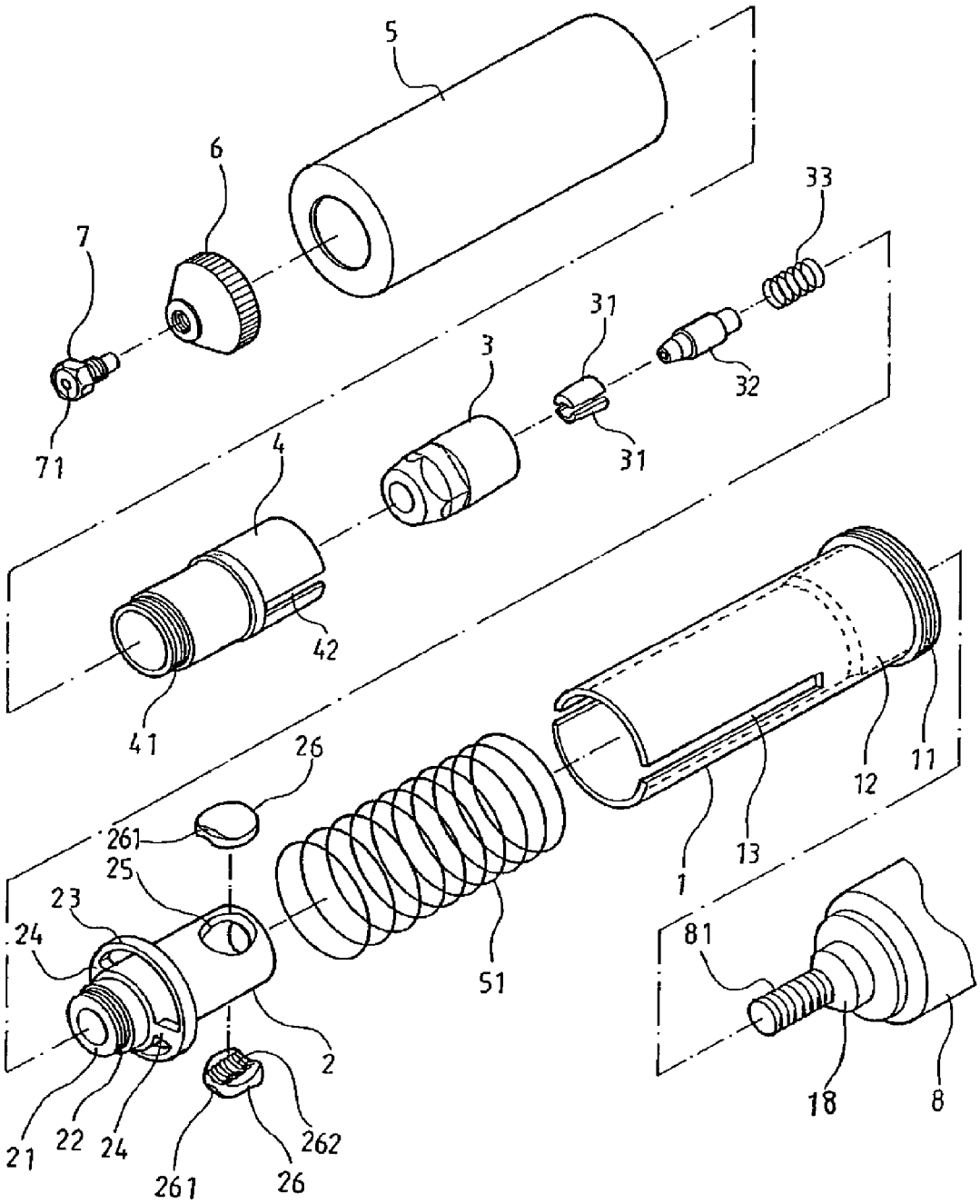
FIG. 2 is an exploded view of the rivet fixing device of the present invention.
Figure 3:
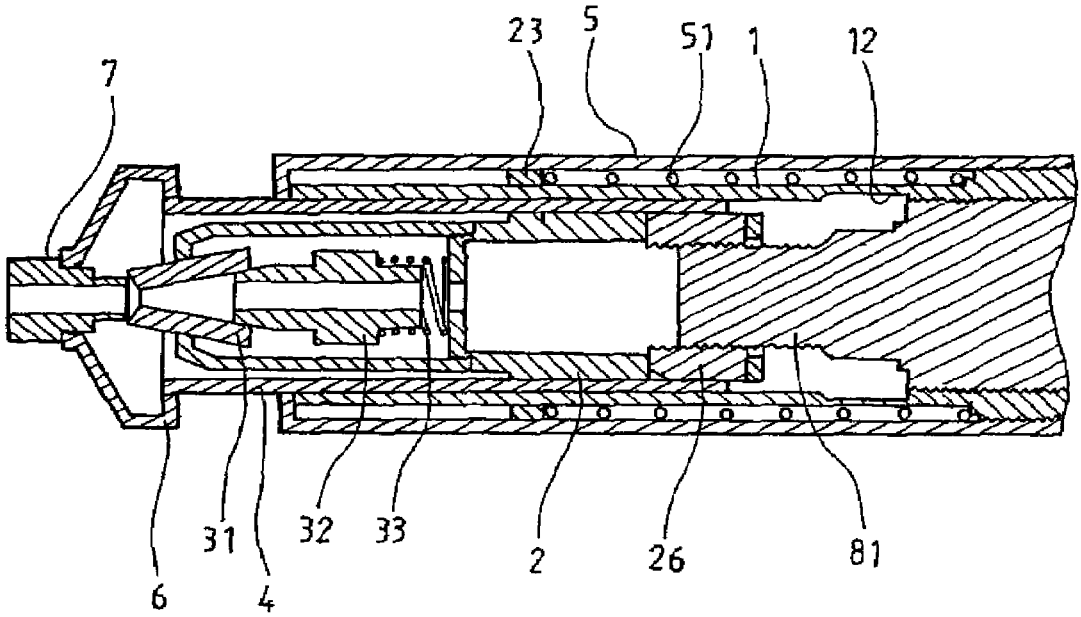
FIG. 3 is a cross-sectional view of the rivet fixing device of the present invention.

Referring to FIGS. 1-3, which are respectively a perspective view of a riveting fixing device in accordance with the present invention coupled to a battery-powered electric drill, an exploded view and a cross-sectional view of the rivet fixing device of the present invention, the rivet fixing device constructed in accordance with the present invention generally comprises an inner guide sleeve 1, a catch tab retainer tube 2, a pawl compartment 3, a driver 4, an outer guide sleeve 5, a driving positioning cap 6, and a rivet breaker 7. The inner guide sleeve 1 comprises a tubular body having a rear end section provided in both internal and external surfaces with threads 11 for threadingly coupling to a transmission mechanism of the battery-powered electric drill, generally designated at 8, and also having an inside surface delimiting an internal bulging chamber 12 frontward of the threads 11. The tubular body of the inner guide sleeve 1 also forms symmetrically arranged open-end slits 13.

The catch tab retainer tube 2 forms a spring chamber 21 in a front end thereof. Threads 22 are formed on an external wall surface of the spring chamber 21. A ring 23 is located rearward of the threads 22. The ring 23 is fixed to a tubular body of catch tab retainer tube 2 by two fixing lugs 24. The catch tab retainer tube 2 defines symmetrically arranged circular openings 25 in a rear end section thereof for respectively receiving therein two catch tabs 26, wherein the catch tabs 26 are curved and have a front end forming, in an upper edge thereof, a ramp 261 and a lower section forming threaded teeth 262.

The a pawl compartment 3, which is threadedly coupled to the threads 22 of the catch tab retainer tube 2 and has a front end section that is conical, forms an interior space receiving therein two duck-beak like pawls 31 and an expander 32 that has a front end section that is conical. The expander 32 is fit in a spring 33 positioned on the spring chamber 21 of the catch tab retainer tube 2.

The driver 4, which has a tubular body receiving the pawl compartment 3 therein, has a front end section provided with threads 41, whereby when projecting beyond the outer guide sleeve 5, the front end section is threadedly coupled to the driving positioning cap 6. The tubular body of the driver 4 forms symmetrically arranged open-end slits 42 for slidingly receiving the fixing lugs 24 of the catch tab retainer tube 2.

The rivet breaker 7 is threadedly secured to the driving positioning cap 6 and forms a holding hole 71.

The outer guide sleeve 5, with a return spring 51 received therein, is threadedly fixed to the inner guide sleeve 1.

With the above discussed constituent components/parts properly assembled, a rivet fixing device in accordance with the present invention is provided, which receives insertion of a rivet having a shank section in such a way that the shank section of the rivet is located on a front end of the rivet breaker 7 and the rivet is then fit through holes defined in two plates, such as steel plates, iron plates, copper plates, and aluminum plates, which are to be riveted together. By depressing the driver 4 inward, the catch tabs 26 of the catch tabs retainer tube 2 are set to engage a transmission spindle 81 of the battery-powered electric drill 8, whereby by setting the battery-powered electric drill 8 in operation, the transmission spindle 81 of the battery-powered electric drill 8 drives the catch tabs 26 of the catch tab retainer tube 2 to move the catch tab retainer tube 2 inwardly. Thus, a fit end of the rivet fit in the holes of the plates is caused to squeeze and deform by the rearward movement of the catch tab retainer tube thereby forming an expanded portion, serving as a positioning wall that stretches and fixes the rivet between the two plates. Further, with the inward movement, the catch tab retainer tube 2 is moved into the bulging chamber 12 of the inner guide sleeve 1 and the catch tabs are driven by a tapering section 18 of the transmission spindle to bulge outward, making the catch tabs 26 that are located in the circular openings 25 outward expanding. Further, with the return spring 51 that is deformed, the driver 4 and the catch tab retainer tube 2 are spontaneously returned and set in the original position. The rivet is broken or cut off by the rivet breaker 7. As such, a convenient and effective operation of mounting a rivet is realized.

Figure 4:
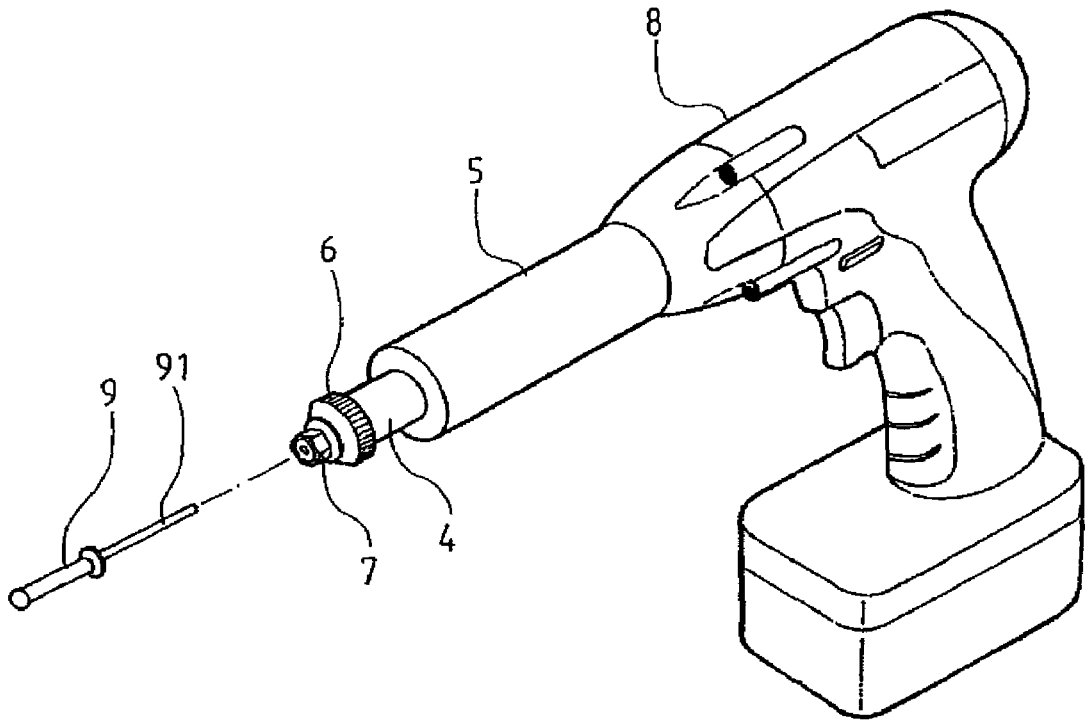
FIG. 4 is a perspective view illustrating inserting a rivet in the rivet fixing device of the present invention.
Figure 5:
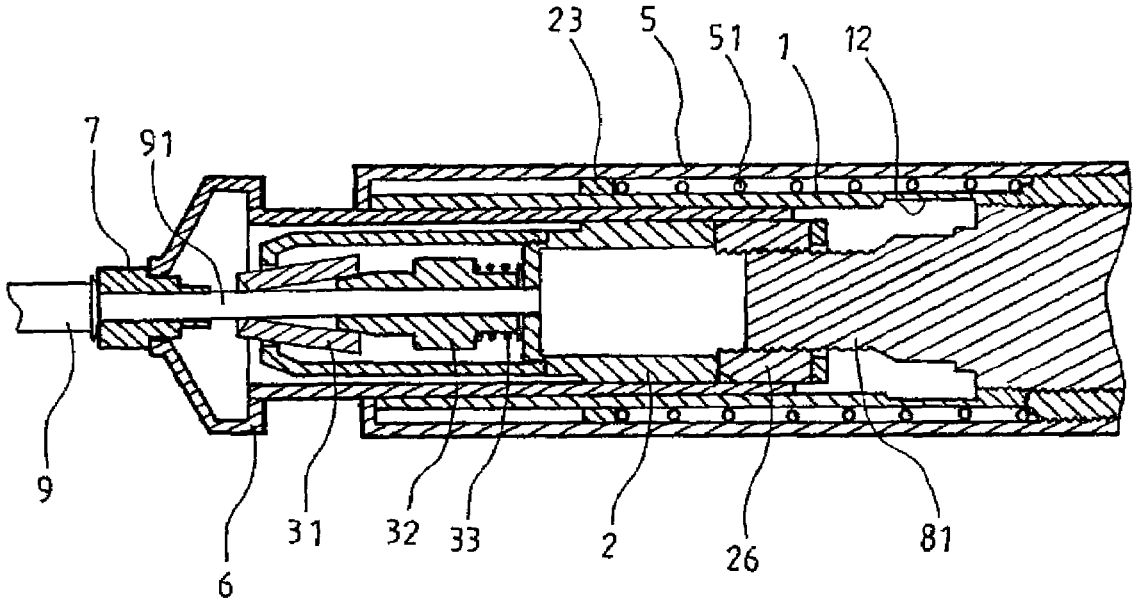
FIG. 5 is a cross-sectional view illustrating inserting a rivet in the rivet fixing device of the present invention.

With reference to both FIGS. 4 and 5, which are a perspective view and a cross-sectional view illustrating inserting a rivet in the rivet fixing device of the present invention, a rivet 9 having a shank section 91 is inserted into the rivet fixing device by inserting the shank section 91 into the front end of the rivet breaker 7. During the insertion, the driver 4 and the driving positioning cap 6 are depressed inward, so that the pawls 31 arranged inside the driver 4 tightly engage the shank section 91 due to being separated from the rivet breaker 7. Then, the electric drill or screwdriver 8 is activated to have the catch tabs 26 of the catch tab retainer tube 2 coupled to the transmission spindle 81 of the battery-powered electric drill 8.

Figure 6:
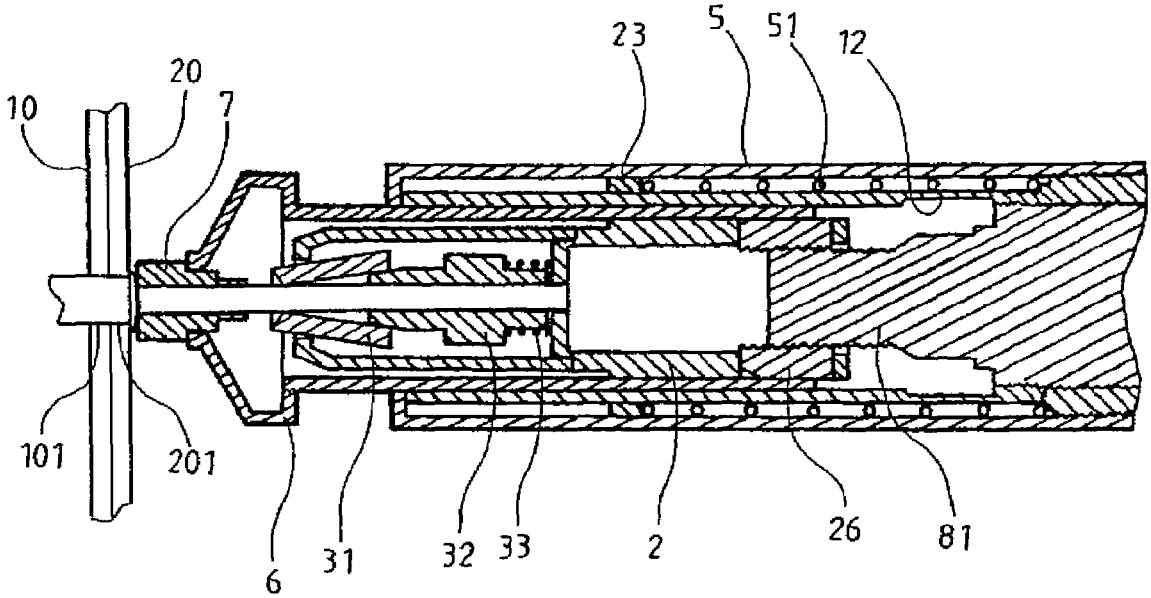
FIG. 6 illustrates a rivet fit through holes defined in steel plates in an application of the present invention.

Also referring to FIG. 6, which illustrates a rivet fit through holes defined in steel plates in an application of the present invention, two steel plates 10, 20 (or other metal plates, such as iron plates, copper plates, and aluminum plates) are machined or drilled to form holes 101, 201. After the shank section 91 of a rivet 9 is attach to the front end of the rivet breaker 7 to couple the rivet 9 to the front tip of the battery-powered electric drill 8, the rivet 9 is fit through the holes 101, 201 of the two steel plates 10, 20 (or other metal plates, such as iron plates, copper plates, and aluminum plates).

Figure 7:
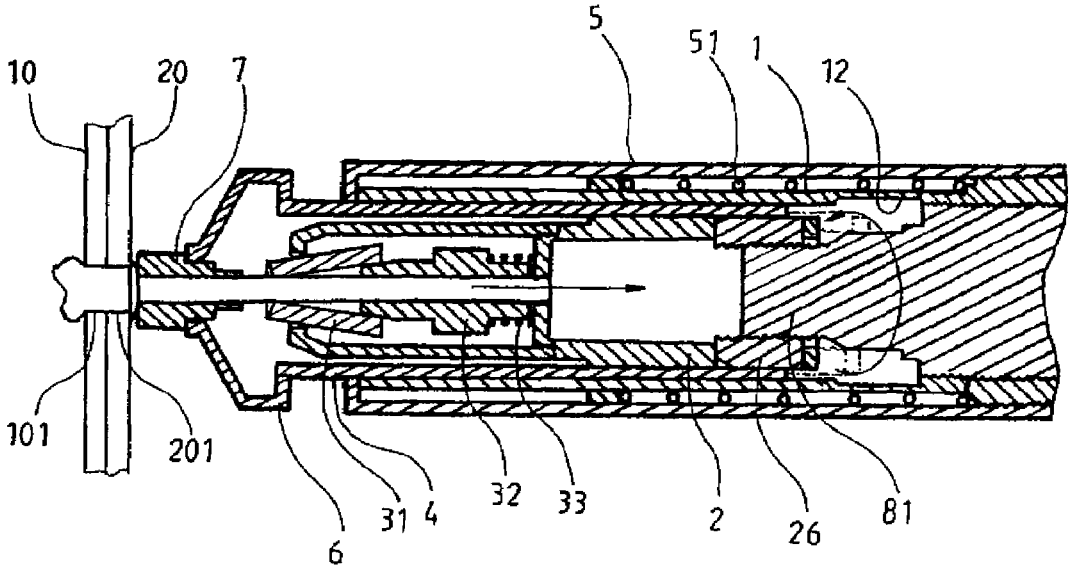
FIG. 7 illustrates a riveting operation realized by the rivet fixing device of the present invention.

Also referring to FIG. 7, which illustrates a riveting operation realized by the rivet fixing device of the present invention, when the rivet 9 is fit through the holes 101, 201 formed in the two steel plates 10, 20 (or other metal plates, such as iron plates, copper plates, and aluminum plates), the battery-powered electric drill 8 is activated. The transmission spindle 81 of the battery-powered electric drill 8 drives the catch tabs 26 located in the circular openings 25 of the catch tab retainer tube 2 to have a fit end of the rivet 9 fit through the holes 101, 201 squeezed and deformed due to the rearward movement of the catch tab retainer tube 2, thereby forming an expanded portion, serving as a positioning wall that stretches and fixes the rivet 9 between the two steel plates 10, 20 thereby securing the steel plates 10, 20 together. With the inward movement, the catch tab retainer tube 2 is moved into the bulging chamber 12 of the inner guide sleeve 1 and, due to the enlarged space of the bulging chamber 12, the catch tabs 26 located in the circular openings 25 of the catch tab retainer tube 2 are outward expanded, so that with the springing force of the spring 51 and the ramps 261 formed on the upper edges of the catch tabs, the catch tab retainer tube 2 is returned and set in the original position. The rivet is then broken or cut off by the rivet breaker 7 to complete the mounting operation of the rivet.

Figure 8:
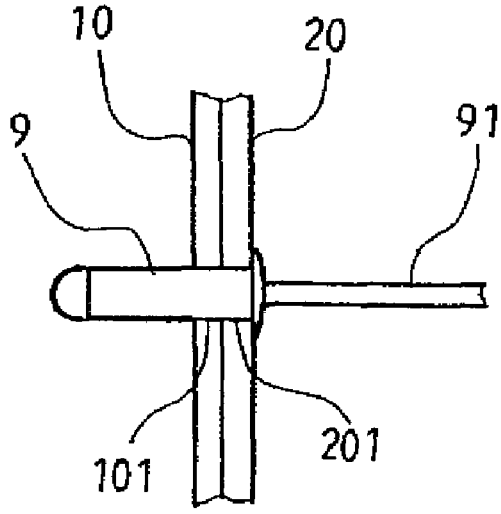
FIG. 8 illustrates securing of plates by a rivet in accordance with the present invention.
Figure 8:
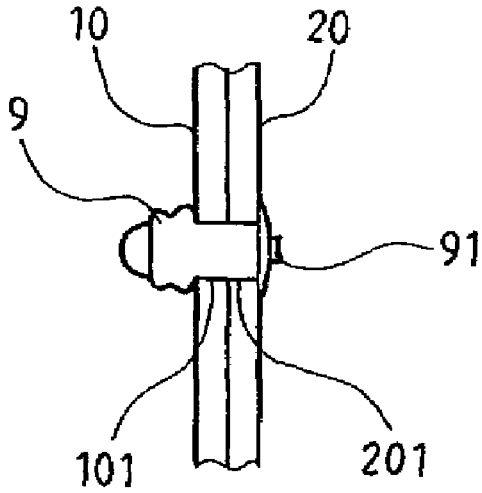

Referring to FIG. 8, which illustrates securing of plates by a rivet in accordance with the present invention, as shown, during the riveting operation carried out with the present invention, the rivet 9 is first fit through the holes 101, 201 defined in the two steel plates 10, 20 (or other metal plates, such as iron plates, copper plates, and aluminum plates) and the rivet 9 is subjected to pulling in the rearward direction by the rivet fixing device to have a fit end thereof squeezed and deformed, thereby forming an expanded portion, serving as a positioning wall, which stretches and fixes the rivet 9 between the two steel plates 10, 20 thereby securing the steel plates 10, 20 together. The process of the operation is convenient and efficient and once riveted, the rivet 9 is tightly secured, hard to separate.

To conclude, the present invention uses constituent parts, such as an inner guide sleeve, a driver, and a catch tab retainer tube, together with rotatably coupling with a transmission spindle of an electrically-operated or battery-powered electric drill or power screwdriver, to construct a rivet fixing device, which makes mounting operation of a rivet easy and efficient, wherein the rivet so mounted is not easy to separate.

With such an arrangement of the cooling device in accordance with the present invention, together with the novel structure of the cooling head for direct contact with a servo to be cooled down and for simultaneous connection with multiple servos, temperature in a localized heat concentration zone can be effectively reduced and such an effect can be realized for however compact and concentrated arrangement of multiple servo racks that support the multiple servos.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A rivet fixing device, comprising:

an inner guide sleeve which has a tubular body having an end section provided with threads adapted to threadedly couple to an electrically-operated or battery-powered electric drill or power screwdriver, said tubular body being provided at an inside surface with an internal bulging chamber and having symmetrical open-end slits;

a catch tab retainer tube having a spring chamber in an end thereof, external threads being formed on an external wall surface of the spring chamber, the catch tab retainer tube having a ring fixed by two fixing lugs and symmetric circular openings in an end section thereof for respectively receiving therein two catch tabs, wherein the catch tabs are curved and have a lower section forming threaded teeth;

a pawl compartment threadedly coupled to the catch tab retainer tube and having a conical end section, the pawl compartment having an interior space receiving two pawls;

an outer guide sleeve fitted over said inner guide sleeve and threadedly engaged with said inner guide sleeve;

a return spring fitted in the outer guide sleeve;

an expander having a conical end section and fit in a spring positioned in the spring chamber of the catch tab retainer tube;

a driver having a tubular body receiving the pawl compartment therein, said driver having an threaded end projecting beyond the outer sleeve to threadedly engage with a driving positioning cap, the expander having symmetric open-end slits for slidingly receiving the fixing lugs of the catch tab retainer tube;

a rivet breaker threadedly secured to the driving positioning cap and having a holding hole;

wherein the rivet fixing device is used for receiving insertion of a rivet having a shank section in such a way that the shank section is located on an end of the rivet breaker, the rivet being then allowed to fit through holes defined in two plates to be riveted together, depressing the driver inward allowing the catch tabs of the catch tabs retainer tube to engage a spindle of the electric drill or the power screwdriver, so that operation of the electric drill or the power screwdriver causes the spindle of the electric drill or the power screwdriver to drive the catch tabs of the catch tab retainer tube for moving the catch tab retainer tube inwardly, thereby squeezing and deforming a fit end of the rivet fit in the holes of the plates by the rearward movement of the catch tab retainer tube to form an expanded portion that stretches and fixes the rivet between the two plates, and wherein with the inward movement, the catch tab retainer tube is moved into the bulging chamber of the inner guide sleeve, the catch tabs within the circular openings being thus allowed to outward bulge and the catch tab retainer tube being allowed to return to an original condition, and the rivet being broken by the rivet breaker.

2. The rivet fixing device according to claim 1, wherein the catch tabs received in the circular openings of the catch tab retainer tube have an end section forming a ramp to facilitate returning of the inner guide sleeve when bulged.

* * * * *